US010948201B2

(12) United States Patent
Takeuchi et al.

(10) Patent No.: US 10,948,201 B2
(45) Date of Patent: Mar. 16, 2021

(54) OUTDOOR UNIT FOR AIR-CONDITIONING APPARATUS

(71) Applicant: Mitsubishi Electric Corporation, Tokyo (JP)

(72) Inventors: Yuto Takeuchi, Tokyo (JP); Kentaro Yonehara, Tokyo (JP); Tatsuya Asanuma, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 101 days.

(21) Appl. No.: 16/314,065

(22) PCT Filed: Oct. 5, 2016

(86) PCT No.: PCT/JP2016/079572
§ 371 (c)(1),
(2) Date: Dec. 28, 2018

(87) PCT Pub. No.: WO2018/066085
PCT Pub. Date: Apr. 12, 2018

(65) Prior Publication Data

US 2019/0323712 A1 Oct. 24, 2019

(51) Int. Cl.
*F24F 1/56* (2011.01)
*F24F 1/48* (2011.01)

(52) U.S. Cl.
CPC . *F24F 1/56* (2013.01); *F24F 1/48* (2013.01)

(58) Field of Classification Search
CPC ..... F24F 1/38; F24F 1/56; F24F 1/48; F04D 29/703
See application file for complete search history.

(56) References Cited

U.S. PATENT DOCUMENTS 1,604,178 A * 10/1926 Lawrence ..... F04D 29/703 416/247 R
1,723,953 A * 8/1929 Ryder ..... F04D 29/542 415/211.2

(Continued)

FOREIGN PATENT DOCUMENTS

JP S52-82258 U 6/1977
JP S55-083663 U 6/1980

(Continued)

OTHER PUBLICATIONS

Extended European Search Report dated Aug. 22, 2019 issued in corresponding EP patent application No. 16918284.7.

(Continued)

*Primary Examiner* — David J Teitelbaum
(74) *Attorney, Agent, or Firm* — Posz Law Group, PLC

(57) ABSTRACT

An outdoor unit for an air-conditioning apparatus has a fan guard covering an air outlet provided in a front panel. The air outlet is opened in a circular shape. The fan guard has a spiral wire formed in a spiral shape and having a hole in a center portion of the spiral wire, a center cap covering the hole, and an outer frame wire that is formed in an annular shape to surround an outer circumference of the spiral wire and in which one end portion and the other end portion at both ends of the annular shape are displaced from each other in a radial direction of the spiral wire and joined to each other at a position of an outer circumferential end portion of the spiral wire.

9 Claims, 5 Drawing Sheets

(56) References Cited

U.S. PATENT DOCUMENTS

| | | | | | |
|---|---|---|---|---|---|
| 2,624,504 | A * | 1/1953 | Viewegh | ..... | F04D 29/703<br>416/247 R |
| 2,656,974 | A | 10/1953 | Holstein | | |
| 3,865,517 | A * | 2/1975 | Simmons | ..... | F25B 39/04<br>417/424.1 |
| 6,790,009 | B1 * | 9/2004 | Carbajal | ..... | F04D 29/703<br>416/247 R |

FOREIGN PATENT DOCUMENTS

| | | | |
|---|---|---|---|
| JP | 3519783 | B2 | 2/1996 |
| JP | 2005-351546 | A | 12/2005 |
| JP | 2007-100979 | A | 4/2007 |

OTHER PUBLICATIONS

International Search Report of the International Searching Authority dated Dec. 13, 2016 for the corresponding international application No. PCT/JP2016/079572 (and English translation).
Office Action dated Nov. 11, 2020 issued in corresponding CN patent application No. 201680089720.7(and English translation).

* cited by examiner

OUTDOOR UNIT FOR AIR-CONDITIONING APPARATUS

CROSS REFERENCE TO RELATED APPLICATION

This application is a U.S. national stage application of PCT/JP2016/079572 filed on Oct. 5, 2016, the contents of which are incorporated herein by reference.

TECHNICAL FIELD

The present invention relates to an outdoor unit for an air-conditioning apparatus having a fan guard including a spiral wire formed in a spiral shape.

BACKGROUND ART

In an existing outdoor unit for an air-conditioning apparatus, a fan guard in which a spiral wire is used is provided at the front in a blowing direction of an air-sending device, and the interval between portions of the spiral wire is specified in such a manner that a finger is prevented from entering the air-sending device (see, for example, Patent Literature 1).

CITATION LIST

Patent Literature

Patent Literature 1: Japanese Unexamined Utility Model Registration Application Publication No. 55-83663

SUMMARY OF INVENTION

Technical Problem

The fan guard in Patent Literature 1 includes a circular outer frame wire and a spiral wire, the interval between the outer circumference of the spiral wire and the outer frame wire is not constant, and a portion of the interval is larger than the interval between portions of the spiral wire. In the case of attempting to narrow the larger portion of the interval with the same configuration, the interval between the portions of the spiral wire is narrowed more than necessary. When the interval between the portions of the spiral wire is narrowed as described above, there is a problem in that the wire rod of the spiral wire has to be longer and the cost is increased.

The fan guard is coated with a resin material for preventing corrosion. When the interval between the portions of the spiral wire is narrowed, corresponding portions of coating film are bridged (coating film bridge) due to surface tension. When coating film bridge occurs, there is a problem in that the design is inferior, and further the air passage area is decreased, resulting in deterioration of aerodynamic performance.

The present invention has been made to solve the above-described problems, and an object of the present invention is to provide an outdoor unit for an air-conditioning apparatus in which the interval between portions of a spiral wire of a fan guard is not narrowed more than necessary.

Solution to Problem

An outdoor unit for an air-conditioning apparatus according to an embodiment of the present invention has a fan guard covering an air outlet provided in a front panel. The air outlet is opened in a circular shape. The fan guard has a spiral wire formed in a spiral shape and having a hole in a center portion of the spiral wire, a center cap covering the hole, and an outer frame wire that is formed in an annular shape to surround an outer circumference of the spiral wire and in which one end portion and the other end portion at both ends of the annular shape are displaced from each other in a radial direction of the spiral wire and joined to each other at a position of an outer circumferential end portion of the spiral wire.

Advantageous Effects of Invention

According to an embodiment of the present invention, the spiral wire formed in a spiral shape and the outer frame wire that is formed in an annular shape to surround the outer circumference of the spiral wire and in which the one end portion and the other end portion at both ends of the annular shape are disposed in the radial direction of the spiral wire and joined to each other at the position of the outer circumferential end portion of the spiral wire, are provided. With this configuration, as it is not necessary to narrow the interval between portions of the spiral wire more than necessary, it is possible to reduce the cost of the spiral wire, and it is possible to inhibit occurrence of coating film bridge between portions of the spiral wire. It is therefore possible to inhibit deterioration of aerodynamic performance.

DESCRIPTION OF EMBODIMENTS

Hereinafter, an outdoor unit for an air-conditioning apparatus according to Embodiment of the present invention will be described in detail with reference to the drawings.

EMBODIMENT

Figure 1:
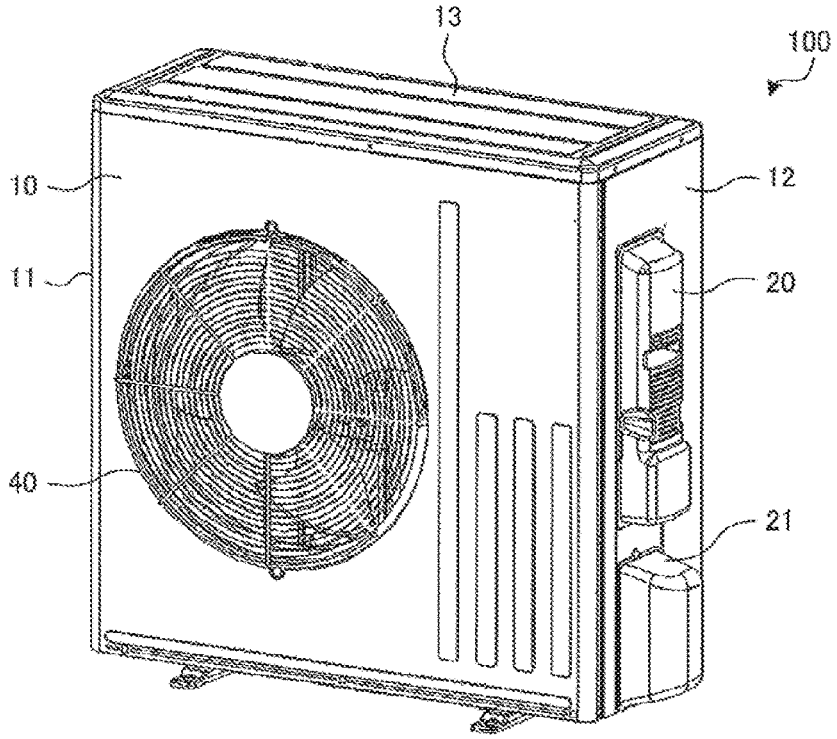
FIG. 1 is a perspective view showing the appearance of an outdoor unit for an air-conditioning apparatus according to Embodiment of the present invention.
Figure 2:
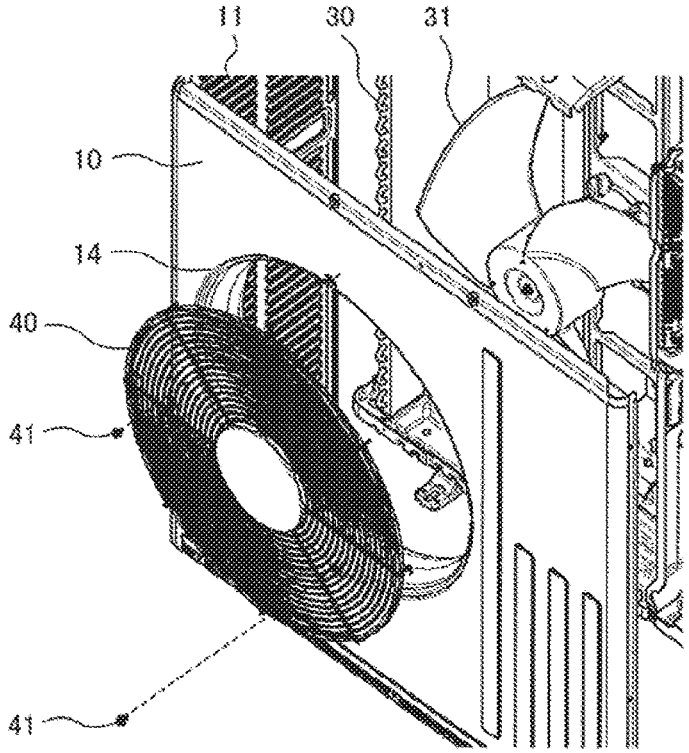
FIG. 2 is a partial perspective view showing a state where a front panel and a fan guard are removed from the outdoor unit in FIG. 1.

FIG. 1 is a perspective view showing the appearance of the outdoor unit for an air-conditioning apparatus according to Embodiment of the present invention. FIG. 2 is a partial perspective view showing a state where a front panel and a fan guard are removed from the outdoor unit in FIG. 1.

As shown in FIGS. 1 and 2, the outdoor unit 100 according to Embodiment has appearance formed by a front panel 10, side panels 11 and 12 that are positioned at the left and the right of the front panel 10, a heat exchanger 30 that is provided opposite to the front panel 10 and has, for example, an L shape, a top panel 13 that covers the top portions of the front panel 10, the side panels 11 and 12, and the heat exchanger 30, and a fan guard 40 that is provided to the front panel 10.

An air outlet 14 formed in a circular shape is provided in the front panel 10. The air outlet 14 faces an air-sending device 31 provided in front of the heat exchanger 30, and is covered with the above-described fan guard 40. The fan guard 40 is fixed to the front panel 10 with screws 41. A service cover 20 and a valve cover 21 are attached to the side panel 12, The air-sending device 31 sucks outdoor air through the heat exchanger 30 and blows out the sucked outdoor air through the fan guard 40 to the front of the front panel 10.

Figure 3:
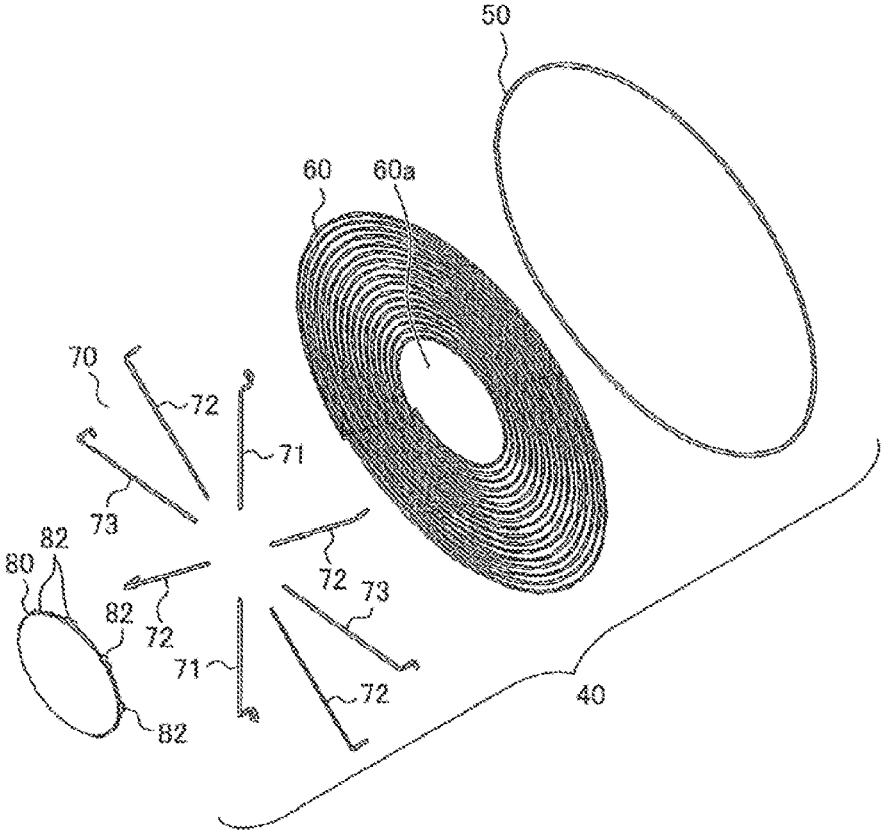
FIG. 3 is an exploded perspective view of the fan guard shown in FIGS. 1 and 2.
Figure 4:
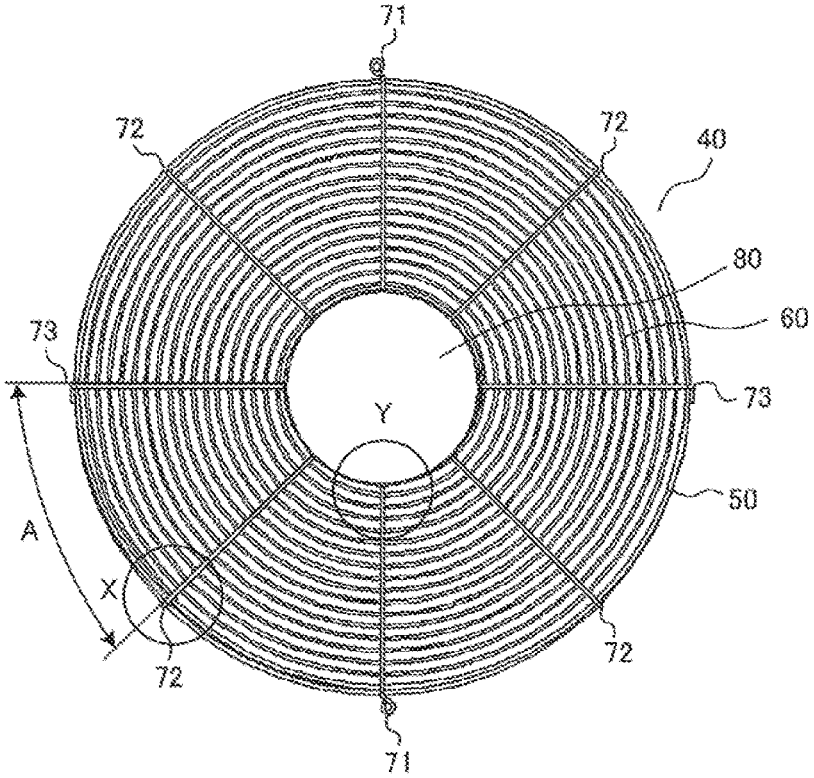
FIG. 4 is a front view of the fan guard shown in FIGS. 1 and 2.

FIG. 3 is an exploded perspective view of the fan guard shown in FIGS. 1 and 2, and FIG. 4 is a front view of the fan guard shown in FIGS. 1 and 2.

As shown in FIG. 3, the fan guard 40 includes an outer frame wire 50 that is formed in an annular shape, a spiral wire 60 that is formed in a spiral shape and has a hole 60*a* in a center portion of the spiral wire 60, a center cap 80 that covers the circular hole 60*a* opened in the center portion of the spiral wire 60, and a radial frame 70 that is formed by portions each radially extends from the center cap 80 across the spiral wire 60 and the outer frame wire 50. The fan guard 40 is coated with a resin material for preventing corrosion.

The outer frame wire 50, the spiral wire 60, and the radial frame 70 are each made of a mild steel wire rod, and the center cap 80 is made of a steel plate that is hot-galvanized. In Embodiment, the mild steel wire rod is used for the outer frame wire 50, the spiral wire 60, and the radial frame 70, and the steel plate is used for the center cap 80, but the materials of these components are not limited.

The outer frame wire 50 is disposed to surround the outer circumference of the spiral wire 60, and joined to the radial frame 70. The outer frame wire 50 is composed of one wire, but the number of wires is not limited. For example, another outer frame wire may be added in addition to the outer frame wire 50, so that there are two outer frame wires. In this case, the other outer frame wire is disposed to surround the outer circumference of the outer frame wire 50, and joined to the radial frame 70. The spiral wire 60 has an inner circumferential end portion from which winding starts, and has an outer circumferential end portion at which the winding ends, and the interval (S1 shown in FIG. 5) between portions of the spiral wire 60 is specified in such a manner that a finger is prevented from entering the air-sending device 31. In many cases, when an interval is not greater than 5.0 mm, coating film bridge is likely to occur. Thus, the interval S1 is an interval that exceeds 5.0 mm and that prevents entry of a finger.

The radial frame 70 includes, for example, three types of rod-like frames 71, 72, and 73 having different end portion shapes (eight rod-like frames in total), and each rod-like frame is disposed to be orthogonal to the axis of the hole 60*a* opened in the spiral wire 60. As shown in FIG. 4, the rod-like frame 71 is positioned in each of the upper region and the lower region in the vertical direction, and the rod-like frame 73 is positioned in each of the right region and the left region in the horizontal direction. In addition, the rod-like frame 72 is positioned in each of regions between the rod-like frames 71 and 73 to form an angle of 45° from the rod-like frames 71 and 73. The types and the number of the rod-like frames 71, 72, and 73 are not limited.

One end portion of each of the rod-like frames 71, 72, and 73 is bent toward the air outlet 14 at a right angle. This is because the rod-like frames 71, 72, and 73 are caused to come into contact with, surround, and sandwich the outer circumferential surface of the outer frame wire 50, which surrounds the outer circumference of the spiral wire 60, from eight directions. In addition, a hole for inserting each of the screws 41 is opened in one end portion of each rod-like frame 71. Each rod-like frame 73 is bent toward the air outlet 14 at a right angle as described above, and the end of one end portion of the rod-like frame 73 is further bent downward at a right angle. This configuration is used to position the fan guard 40 to be attached to the air outlet 14. The other end portions of the rod-like frames 71, 72, and 73 are each fixed to a corresponding one of fixing portions 82 provided to the center cap 80, as described later.

Here, the configuration of the fan guard 40 at the outer circumferential region will be described with reference to FIG. 5.

Figure 5:
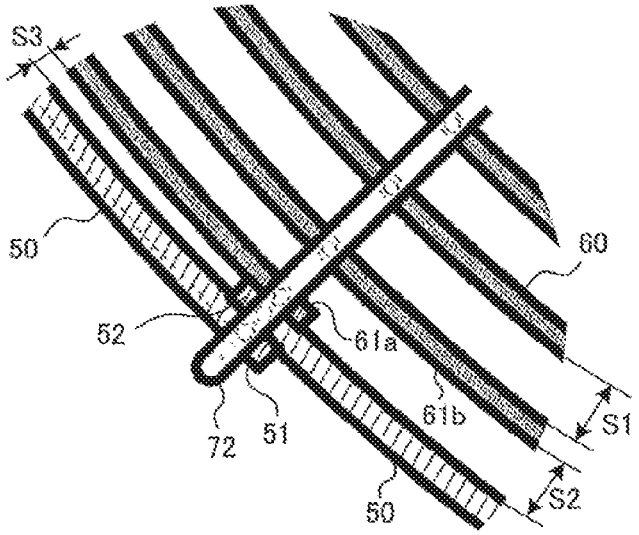
FIG. 5 is a detailed diagram of an outer circumferential region of the fan guard, showing a part X in FIG. 4 in an enlarged manner.

FIG. 5 is a detailed diagram of the outer circumferential region of the fan guard, showing a part X in FIG. 4 in an enlarged manner.

In Embodiment, in the outer frame wire 50 that forms the outer frame of the fan guard 40, one end portion 51 and the other end portion 52 at both ends of the annular shape are displaced from each other in the radial direction of the spiral wire 60 at the position of an outer circumferential end portion 61*a* of the spiral wire 60 and joined to the outer circumferential end portion 61*a*.

That is, the other end portion 52 of the outer frame wire 50 is positioned between the one end portion 51 of the outer frame wire 50 and the outer circumferential end portion 61*a*, at which winding of the spiral wire 60 ends, in the radial direction of the spiral wire 60. The one end portion 51 and the other end portion 52 of the outer frame wire 50 are joined to each other by welding or other similar method. The outer circumferential end portion 61*a* of the spiral wire 60 is joined to the other end portion 52 of the outer frame wire 50 by welding or other similar method and joined to the rod-like frame 72 of the radial frame 70.

It is possible to position the other end portion 52 of the outer frame wire 50 in the inner region as compared to the case where the end portions (end surfaces) of the outer frame wire 50 are joined to each other, and thus it is possible to narrow an interval S2 between the outer frame wire 50 and an outer circumferential wire 61*b* of the spiral wire 60 without changing the interval S1 between portions of the spiral wire 60.

Meanwhile, a portion of an interval S3 between the outer circumferential end portion 61*a* of the spiral wire 60 and the one end portion 51 of the outer frame wire 50 is narrower than the interval S1 between portions of the spiral wire 60. In this case, regarding the design on the appearance, in the portion with the interval S3, the color difference from the front panel 10 around the spiral wire 60 is hard to feel. In addition, regarding the aerodynamic performance, there is a possibility of occurrence of coating film bridge in the portion with the interval S3, that is, in the range (about) 45° of a part A shown in FIG. 4, but it is possible to minimize the occurrence within the range of the part A, and it is possible to reduce the influence with the interval S3.

Next, the configuration of the center cap 80 of the fan guard 40 will be described with reference to FIGS. 6 and 7.

Figure 6:
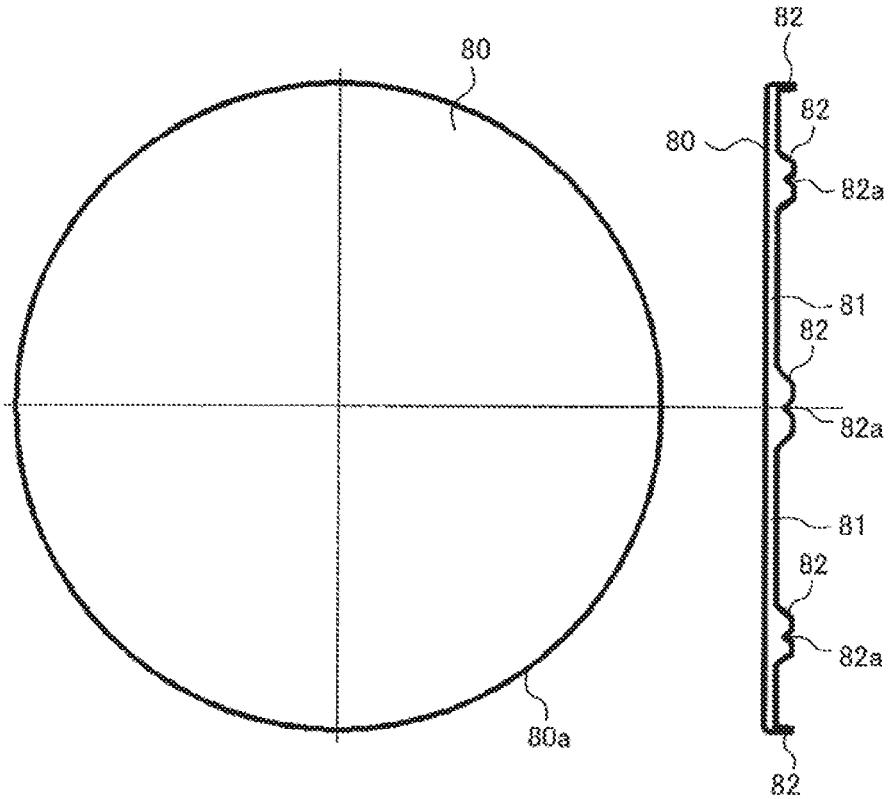
FIG. 6 shows a front view and a side view showing a center cap in FIG. 1 in an enlarged manner.
Figure 7:
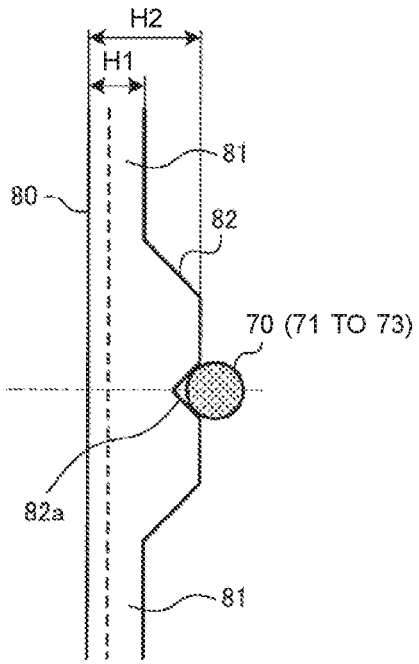
FIG. 7 is a side view showing a portion of an outer circumferential frame portion of the center cap in FIG. 6 in an enlarged manner.

FIG. 6 shows a front view and a side view showing the center cap in FIG. 1 in an enlarged manner; and FIG. 7 is a side view showing a portion of an outer circumferential frame portion of the center cap in FIG. 6.

The center cap 80 is formed in a circular shape, and the fixing portions 82 for fixing the radial frame 70 are provided on the outer circumferential portion of the center cap 80. Specifically, the center cap 80 includes the annular outer circumferential frame portion 81 that is formed at an outer circumferential portion 80*a* of the center cap 80 to project toward the air outlet 14, and the fixing portions 82 that are provided at regular intervals to further project from the outer circumferential frame portion 81 toward the air outlet 14 and each have a V-shaped groove 82*a* for fixing the radial frame 70.

As shown in FIG. 7, the height of the outer circumferential frame portion 81 is represented by H1 from the surface of the center cap 80, and the height of each fixing portion 82 is represented by H2 that is longer than the height H1 of the outer circumferential frame portion 81. As described later, the spiral wire 60 has a portion extending across a portion of the center cap 80, and thus the height H1 of the outer circumferential frame portion 81 is specified to be short to prevent occurrence of coating film bridge between the portion of the center cap 80 and the spiral wire 60. The grooves 82*a* of the fixing portions 82 are provided for positioning the rod-like frames 71, 72, and 73, which form the radial frame 70, and fixing the rod-like frames 71, 72, and 73 by welding or other similar method.

Next, the configuration of the inner circumferential region of the fan guard 40 will be described with reference to FIGS. 8 and 9.

Figure 8:
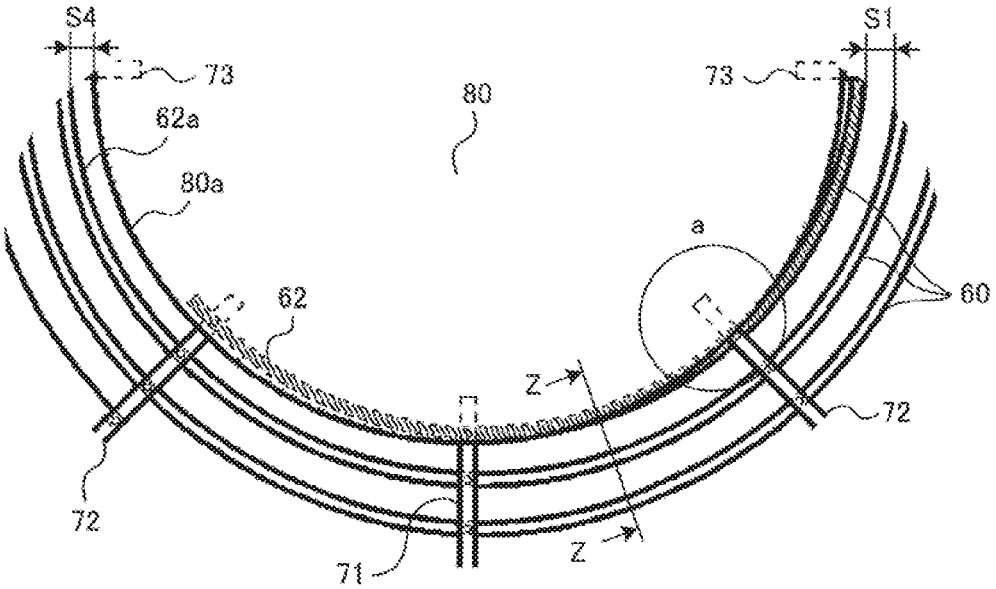
FIG. 8 is a detailed diagram of an inner circumferential region of the fan guard, showing a part Y in FIG. 4 in an enlarged manner.
Figure 9:
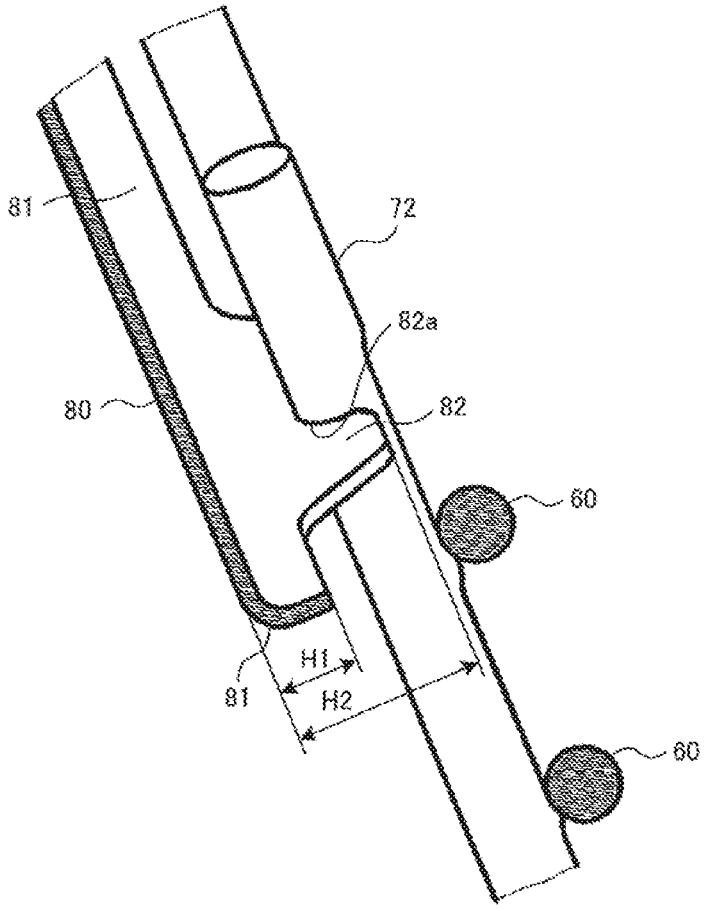
FIG. 9 is a cross-sectional view of a portion of the center cap and portions of a spiral wire in FIG. 8 as seen from an arrow Z-Z direction.

FIG. 8 is a detailed diagram of the inner circumferential region of the fan guard, showing a part Y in FIG. 4 in an enlarged manner, and FIG. 9 is a cross-sectional view of a portion of the center cap and portions of the spiral wire in FIG. 8 as seen from an arrow Z-Z direction.

In Embodiment, an inner circumferential end portion 62 from which winding of the spiral wire 60 starts is positioned in the inner region of the center cap 80 in such a manner that an interval S4 between the outer circumferential portion 80*a* of the center cap 80 and an inner circumferential wire 62*a* of the spiral wire 60 is substantially equal to the interval S1 between portions of the spiral wire 60. In this case, there is a portion a in which the inner circumferential end portion 62 of the spiral wire 60 extends across the outer circumferential portion 80*a* of the center cap 80 (see FIG. 8).

In the portion a, coating film bridge is likely to occur between the outer circumferential portion 80*a* of the center cap 80 and the inner circumferential end portion 62 of the spiral wire 60, but in Embodiment, it is possible to prevent coating film bridge, which is likely to occur in the portion a, as the height H1 from the surface of the center cap 80 to the end of the outer circumferential frame portion 81 is shorter than the height H2 to the end of each of the fixing portions 82 as shown in FIGS. 8 and 9.

The other end portions of the rod-like frames 71, 72, and 73, which form the radial frame 70, are each fixed to a corresponding one of the fixing portions 82, which are provided to the center cap 80, by welding or other similar method. For example, the rod-like frame 72 is fixed to the V-shaped groove 82*a* of the fixing portion 82 as shown in FIG. 9. The radial frame 70 is positioned by the grooves 82*a*.

According to Embodiment, in the outer circumferential region of the fan guard 40, the other end portion 52 of the outer frame wire 50 is positioned between the one end portion 51 of the outer frame wire 50 and the outer circumferential end portion 61*a* of the spiral wire 60 in the radial direction of the spiral wire 60. With this configuration, it is possible to position the other end portion 52 of the outer frame wire 50 in the inner region, and thus it is possible to narrow the interval S2 between the outer frame wire 50 and the outer circumferential wire 61*b* of the spiral wire 60 without changing the interval S1 between portions of the spiral wire 60. In addition, in the inner circumferential region of the fan guard 40, the inner circumferential end portion 62 of the spiral wire 60 is positioned in the inner region of the center cap 80 to cause the interval S4 between the outer circumferential portion 80*a* of the center cap 80 and the inner circumferential wire 62*a* of the spiral wire 60 to be substantially equal to the interval S1 between portions of the spiral wire 60.

With the above configuration, in the outer circumferential region and the inner circumferential region of the fan guard 40, a gap between portions of the spiral wire 60 that a finger can enter is eliminated, so that the design on the appearance is not impaired. In addition, as it is not necessary to narrow the interval S1 between portions of the spiral wire 60 more than necessary, it is possible to reduce the cost of the spiral wire 60, and it is possible to inhibit occurrence of coating film bridge between portions of the spiral wire 60. It is therefore possible to inhibit deterioration of aerodynamic performance. Furthermore, as the height H1 from the surface of the center cap 80 to the end of the outer circumferential frame portion 81 is shorter than the height H2 to the end of each of the fixing portions 82, it is possible to prevent coating film bridge that is likely to occur in the portion a in the inner circumferential region of the fan guard 40.

In Embodiment, in the outer circumferential region of the fan guard 40, the other end portion 52 of the outer frame wire 50 is positioned between the one end portion 51 of the outer frame wire 50 and the outer circumferential end portion 61*a* of the spiral wire 60 in the radial direction of the spiral wire 60, but the configuration is not limited to this description. For example, the outer circumferential end portion 61*a* of the spiral wire 60 may be positioned between the one end portion 51 and the other end portion 52 of the outer frame wire 50 in the radial direction of the spiral wire 60.

| Reference Signs List |
|---|
| 10 front panel |
| 11, 12 side panel |
| 13 top panel |
| 14 air outlet |
| 20 service cover |
| 21 valve cover |
| 30 heat exchanger |
| 31 air-sending device |
| 40 fan guard |
| 41 screw |
| 50 outer frame wire |
| 51 end portion of outer frame wire |
| 52 other end portion of outer frame wire |
| 60 spiral wire |
| 60a hole |
| 61a outer circumferential end portion |
| 61b outer circumferential wire |
| 62 inner circumferential end portion |
| 62a inner circumferential wire |
| 70 radial frame |
| 71, 72, 73 rod-like frame |
| 80 center cap |
| 80a outer circumferential portion |
| 81 outer circumferential frame portion |
| 82 fixing portion |

-continued

| Reference Signs List |
| --- |
| 82a groove<br>100 outdoor unit |

The invention claimed is:

1. An outdoor unit for an air-conditioning apparatus, comprising a fan guard covering an air outlet provided in a front panel, the air outlet being opened in a circular shape, the fan guard having a spiral wire formed in a spiral shape and having a hole in a center portion of the spiral wire, a center cap covering the hole, and an outer frame wire that is formed in an annular shape to surround an outer circumference of the spiral wire and in which one end portion and an other end portion at both ends of the annular shape are displaced from each other in a radial direction of the spiral wire and joined to each other at a position of an outer circumferential end portion of the spiral wire.

2. The outdoor unit for an air-conditioning apparatus of claim 1, further comprising a radial frame formed by portions each radially extending from the center cap across the spiral wire and the outer frame wire, wherein the outer circumferential end portion of the spiral wire is joined to the radial frame.

3. The outdoor unit for an air-conditioning apparatus of claim 1, wherein the other end portion of the outer frame wire is positioned between the one end portion of the outer frame wire and the outer circumferential end portion of the spiral wire.

4. The outdoor unit for an air-conditioning apparatus of claim 1, wherein the outer circumferential end portion of the spiral wire is positioned between the one end portion and the other end portion of the outer frame wire.

5. The outdoor unit for an air-conditioning apparatus of claim 1, wherein an inner circumferential end portion of the spiral wire is positioned in an inner region of the center cap.

6. The outdoor unit for an air-conditioning apparatus of claim 2, wherein a fixing portion for fixing the radial frame to an outer circumferential portion of the center cap is provided to the center cap.

7. The outdoor unit for an air-conditioning apparatus of claim 6, wherein an outer circumferential frame portion projecting toward the air outlet is provided to the outer circumferential portion of the center cap, and the fixing portion further projects from the outer circumferential frame portion toward the air outlet and has a groove for fixing the radial frame.

8. The outdoor unit for an air-conditioning apparatus of claim 1, wherein a distance from the center portion of the outer frame wire is gradually reduced from a maximum distance at the one end portion to a minimum distance at the other end portion.

9. The outdoor unit for an air-conditioning apparatus of claim 1, wherein the outer frame wire extends in a first angular direction from the one end portion to the other end portion, the spiral wire is wound in a second angular direction from an outermost end to an innermost end, and the first angular direction is the same as the second angular direction.

* * * * *